United States Patent [19]

Han et al.

[11] Patent Number: 4,930,993

[45] Date of Patent: Jun. 5, 1990

[54] ENERGY REGENERATIVE APPARATUS FOR A WATER HAMMER TYPE PUMP

[76] Inventors: Tai-Kang Han; Tai-Feng Chang, both of No. 18, Lane 787, Sec. 2, Kuo Kuang Rd., Ta Li Hsiang, Taichung Hsien, Taiwan

[21] Appl. No.: 376,680

[22] Filed: Jul. 7, 1989

[51] Int. Cl.[5] ..... F04F 7/02

[52] U.S. Cl. ..... 417/226; 60/639

[58] Field of Search ..... 417/225, 226, 227, 313; 60/639, 496

[56] References Cited

U.S. PATENT DOCUMENTS

| | | | |
|---|---|---|---|
| 996,056 | 6/1911 | Brodton | 417/226 |
| 1,530,182 | 3/1925 | Jordão, Jr. | 417/226 |
| 4,073,604 | 2/1978 | Chen | 137/529 X |

*Primary Examiner*—John C. Fox

*Attorney, Agent, or Firm*—Morton J. Rosenberg; David I. Klein

[57] ABSTRACT

An energy regenerative apparatus for a water hammer type pump includes a water hammer type pump and an engergy regenerative apparatus. The water hammer type pump includes a reservoir which is connected to a pump body by a pipe. A pressure tank is fixed on top of the pump body. A piston rod with a piston head is slidably provided in the pump body. A water passage between the pump body and the pressure tank is controllable by the piston head so as to control a flow of water from the pump body to the pressure tank. A flat valve is disposed between an outlet pipe and the pressure tank so as to prevent any reverse flow of water from the outlet pipe into the tank. A water gate valve is provided for controlling a water passage of the pump body. The energy regenerative apparatus includes a rack connected to a lower end of the piston rod and a pinion driven by the rack so as to drive a ratchet by means of a pair of rocker levels and produce a power output from an axle of the ratchet by means of an up and down movement of the piston rod of the water hammer type pump.

3 Claims, 3 Drawing Sheets

ENERGY REGENERATIVE APPARATUS FOR A WATER HAMMER TYPE PUMP

FIELD OF THE INVENTION

The present invention relates to an energy regenerative apparatus, and more particularly to an energy regenerative apparatus for a water hammer type pump.

BACKGROUND OF THE INVENTION

Water hammer type pumps are widely used in rural or suburban area where no electricity is available. An example of a water hammer type pump is provided in U.S. Pat. No. 4,073,604, as shown in FIG. 3. Water from a reservoir R, generally accumulated from a river, flows into the pump body B through a pipe P, raising the pressure in the pump body B. Suddenly, when the pressure within the pump body B is high enough, the valve V is closed. The pressure within the pump body B is further increased so as to push the piston head H move upward. Then, the water flows from the pump body B into the pressure tank T, from where it will be passed to the outlet pipe O by means of air pressure in the pressure tank T. As water is discharged from the pump body B to the pressure tank T, the pressure in the pump body B will be decreased, causing the piston head H to close and the valve V to open. Again, water flows from the reservoir R into the pump body B and begin another cycle. A flat valve F is provided between the outlet pipe O and the pressure tank T so as to prevent any reverse flow of water in order that water may be transferred to higher ground. An up and down movement of the piston stem S is utilized to drive a water drawing pump W in order to draw water from an under ground source to the reservoir R.

This pump tried to use the up and down motion of the piston stem S to draw all the water flowing through the valve V back to the reservoir R, this is similar to a perpetual motion which is impossible due to friction loss. Besides, the water used as a power source of the water hammer type pump is generally a river. Therefore, it is no need to worry about the supply of the water. The water drawing pump W appears to be redundant.

SUMMARY OF THE INVENTION

The primary object of the present invention is to provide an energy regenerative apparatus for a water hammer type pump which converts the up and down movement of the piston of the water hammer type pump into a useful power output for the area where no electricity is available.

The present invention seeks to provide an energy regenerative apparatus for a water hammer type pump which generally includes a water hammer type pump and an energy regenerative apparatus. The water hammer type pump includes a reservoir which is connected to a pump body by a pipe. A pressure tank is fixed on top of the pump body. A piston rod with a piston head is slidably provided in the pump body. A water passage between the pump body and the pressure tank is controllable by the piston head so as to control a flow of water from the pump body to the pressure tank. A flat valve is disposed between an outlet pipe and the pressure tank so as to prevent any reverse flow of water from the outlet pipe into the tank. A water gate valve is provided for controlling a water passage of the pump body. The energy regenerative apparatus includes a rack connected to a lower end of the piston rod and a pinion driven by the rack so as to drive a ratchet by means of a pair of rocker levels and produce a power output from an axle of the ratchet by means of an up and down movement of the piston rod of the water hammer type pump.

Further objects and advantages of the present invention will become apparent from a careful reading of the detailed description provided hereinbelow, with appropriate reference to the accompanying drawings.

DETAILED DESCRIPTION OF THE INVENTION

Figure 1:
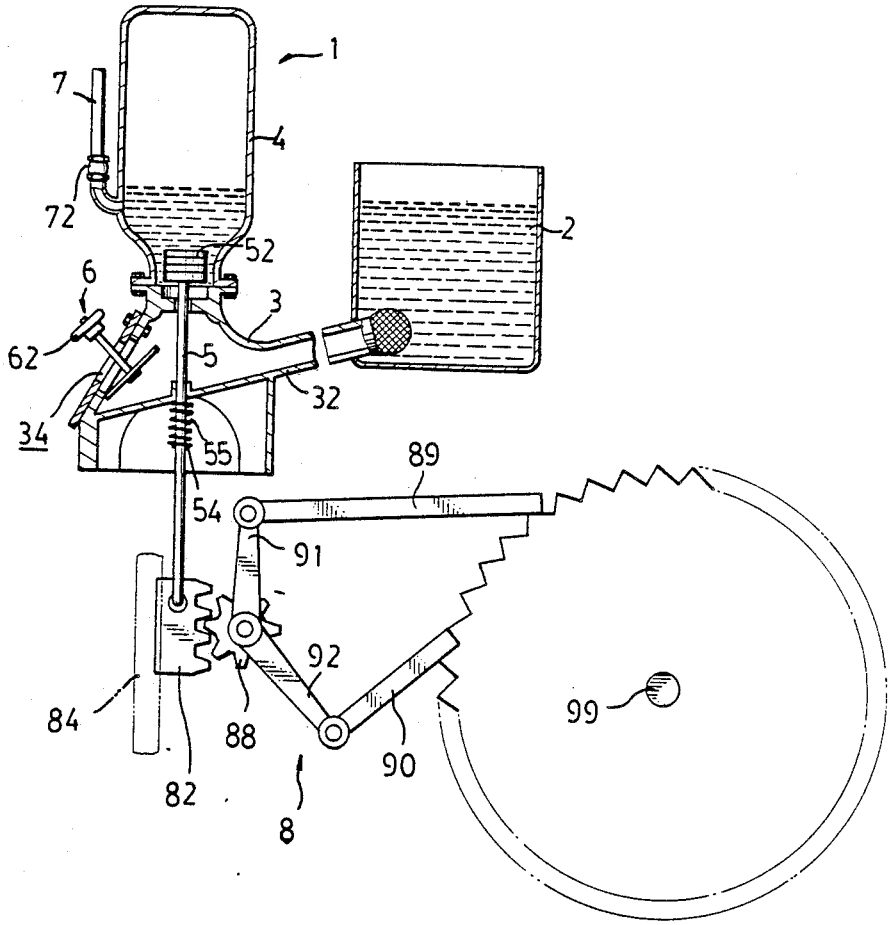
FIG. 1 is a partial cross sectional view of an energy regenerative apparatus for a water hammer type pump in accordance with the present invention.

Referring to the drawings and initially to FIG. 1, the energy regenerative apparatus for a water hammer type pump in accordance with the present invention comprises generally a water hammer type pump 1 and an energy regenerative apparatus 8.

The water hammer type pump 1 comprises generally a reservoir 2, substantially a river, which is connected to a pump body 3 by a pipe 32; and a pressure tank 4 being fixed on top of the pump body 3. A piston rod 5 with a piston head 52 is slidably provided in the pump body 3. A water passage between the pump body 3 and the pressure tank 4 is controllable by the piston head 52 so as to control the flow of the water from the pump body 3 to the pressure tank 4. A flat valve 72 is disposed between an outlet pipe 7 and the pressure tank 4 so as to prevent any reverse flow of water from the outlet pipe 7 into the tank 4. A water gate valve 6 with a handle 62 is provided on one side of the pump body 3 for controlling open and close conditions of a through hole 34 provided on a lateral surface of the pump body 3, and consequently, controlling a water flow through the through hole 34. A spring member 55 is disposed on a lower end of the piston rod 5 and bears between a lower surface of the pump body 3 and a flange 54 fixed at a lower end of the piston rod 5 in order to push the piston rod 5 constantly downward.

The energy regenerative apparatus 8 comprises a rack 82 being connected to a lower end of the piston rod 5 and slidable along a track 84 which is fixed relatively to the pump body 3; and a pinion 88 driven by the rack 82 so as to drive a ratchet 98 by means of a pair of rocker levels 89, 90. The rocker levels 89, 90 are respectively pivoted on rocker arms 91, 92 which are fixed relative to the pinion 88; i.e. the rocker arms 91, 92 rotates with the pinion 88.

When it is desired to use a power output from a turning axle 99 of the ratchet 98, the water hammer type pump 1 is to be actuated. All you need to actuate the water hammer type pump 1 is pushing the valve 6 open for several seconds by means of the handle 62. Water in the pump body 3 starts flowing through the through hole 34, and water from the reservoir 2 flows into the pump body 3, increasing the pressure in the pump body 3. When the pressure in the pump body 3 is large enough, the valve 6 is closed by the increased pressure. Therefore, the piston head 52 is pushed by the pressure in the pump body 3 when the pressure in the pump body 3 is further increased to a substantial level which is large enough to push the piston head 52. At this moment, water flows from the pump body 3 into the pressure tank 4 and further flows through the outlet pipe 7 by means of the air pressure within the pressure tank 4. The flat valve 72 prevent the water from flowing back the the pressure tank 4. As water flows into the pressure tank 4, the pressure in the pump body 3 will be decreased. Therefore, the piston head 52 is lowered to close the water passage between the pump body 3 and the pressure tank 4 by means of weight and the spring force of the spring member 55. Simultaneously, the valve 6 is opened. Again, water flows from the reservoir 2 into the pump body 3 starting another working cycle.

Figure 2:
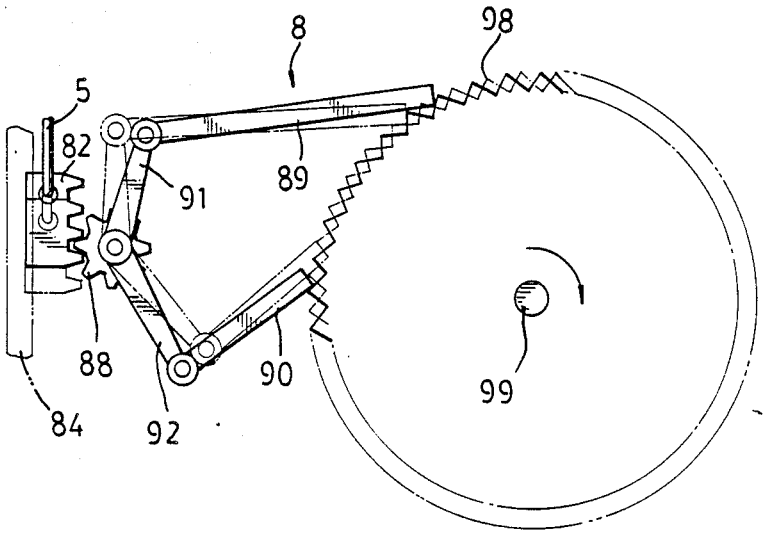
FIG. 2 is a partial cross sectional view illustrating movements of an energy regenerative apparatus in accordance with the present invention.
Figure 3:
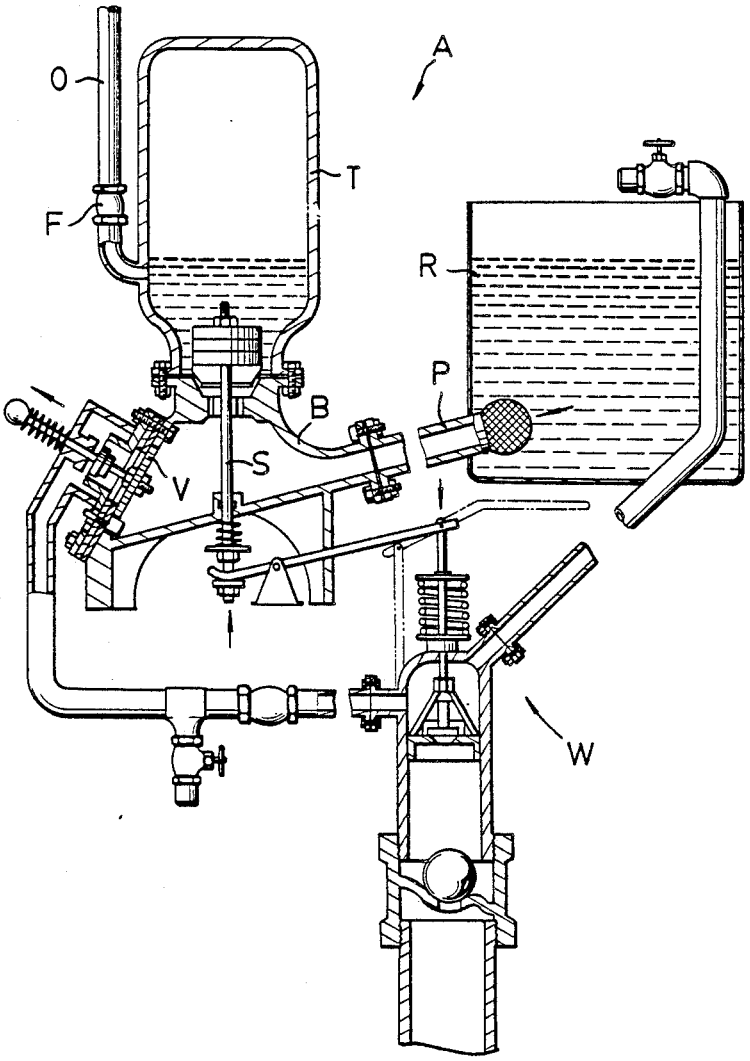
FIG. 3 PRIOR ART
FIG. 3 is a partial cross sectional view of a conventional water hammer type pump.

Referring next to FIG. 2, illustrating a movement of the energy regenerative apparatus 8 in accordance with the present invention. The up and down movement of the piston rod 5 effects the rack 82 moving up and down along the track 84. Consequently, the pinion 88 and the rocker arms 91, 92 are rotatable between the positions as shown in solid lines and in imaginary lines in FIG. 2. The rotations of the rocker arms 91, 92 about an axle of the pinion 88 make the rocker levels 89, 90 respectively move back and forth with respect to the ratchet 98. When the pinion 88 rotates clockwise to the position as shown in solid lines, the upper level 89 pushes a gear on the ratchet 98 forward, and the lower level 90 is drawn back to engage a next gear. On the contrary, when the pinion 88 rotates counterclockwise to the position as shown in imaginary lines, the upper level 89 is drawn back to engage a next gear, and the lower level 90 pushes the gear forward causing a rotation of the ratchet 98. One of the levels 89, 90 pushes the ratchet 98 rotating a pitch when the pinion 88 either rotates clockwise or counterclockwise. Therefore, a rotary motion of the ratchet 98 is obtained, and a rotational power output of the axle 99 of the ratchet 98 is available, for example, serving as a power source for such as a generator (not shown). It will be seen from the foregoing that there has been provided an energy regenerative apparatus for a water hammer type pump for use in a suburb or rural area whereby a power supply is provided for those area where no electricity is available.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An energy regenerative apparatus for a water hammer type pump generally comprising a water hammer type pump and an energy regenerative apparatus;

said water hammer type pump including a reservoir which is connected to a pump body by a pipe; a pressure tank being fixed on top of said pump body; a piston rod with a piston head being slidably provided in said pump body; a water passage between said pump body and said pressure tank being controllable by said piston head so as to control a flow of water from said pump body to said pressure tank; a flat valve being disposed between an outlet pipe and said pressure tank so as to prevent any reverse flow of water from said outlet pipe into said tank; and a water gate valve with a handle being provided on one side of said pump body for controlling a water passage of said pump body;

said energy regenerative apparatus including a rack being connected to a lower end of said piston rod; and a pinion being driven by said rack so as to drive a ratchet by means of a pair of rocker levels which are rotatable with said pinion so as to produce a power output from an axle of said ratchet by means of an up and down movement of said piston rod of said water hammer type pump.

2. An energy regenerative apparatus as set forth in claim 1, wherein a track is further provided and fixed relative to said pump for slidably holding said rack thereon.

3. An energy regenerative apparatus as set forth in claim 1, wherein said rocker levers are respectively pivoted on a pair of rocker arms which are substantially fixed relative to said pinion.

* * * * *